US006212780B1

(12) United States Patent
Huang

(10) Patent No.: US 6,212,780 B1
(45) Date of Patent: Apr. 10, 2001

(54) ADJUSTABLE HANDLE FOR SCISSORS OR THE LIKE

(76) Inventor: Te Chien Huang, No. 6, Avenue 32, Lane 300, Sec. 2, Ching Hai Road, Taichung (TW)

( * ) Notice: Subject to any disclaimer, the term of this patent is extended or adjusted under 35 U.S.C. 154(b) by 0 days.

(21) Appl. No.: 09/225,407

(22) Filed: Jan. 5, 1999

(51) Int. Cl.[7] ..... B26B 13/20
(52) U.S. Cl. ..... 30/232; 30/298
(58) Field of Search ..... 30/232, 253, 262, 30/298, 341, 256, 291

(56) References Cited

U.S. PATENT DOCUMENTS 5,109,608 * 5/1992 Pracht ..... 30/232 X
5,781,999 * 7/1998 Chang ..... 30/341 X
5,953,823 * 9/1999 Huang ..... 30/232

* cited by examiner

*Primary Examiner*—M. Rachuba
*Assistant Examiner*—T. Anthony Vaughn
(74) *Attorney, Agent, or Firm*—Charles E. Baxley

(57) ABSTRACT

A cutting instrument includes a pair of pivotally coupled blades and a pair of handles attached to the blades respectively. One of the handles may be adjusted relative to one of the blades by a quick-release latching mechanism, for fitting the users' fingers of various sizes. The handle may include a slot for receiving the blade and may include a cam for locking the handle to the blade. The handle may also include a base and a cap adjustably secured to the base for forming a loop and for receiving fingers of various sizes.

9 Claims, 7 Drawing Sheets

ADJUSTABLE HANDLE FOR SCISSORS OR THE LIKE

BACKGROUND OF THE INVENTION

1. Field of the Invention

The present invention relates to a cutting instrument, and more particularly to a cutting instrument, such as scissors having an adjustable handle for fitting the users' fingers of various sizes.

2. Description of the Prior Art

Typical cutting instruments, such as scissors, comprise a pair of blades pivotally coupled together and each having a handle secured to one end thereof. The handles each has an opening for receiving the fingers of the users. However, the openings of the handles may not be changed or adjusted for fitting various sizes of the users' fingers.

The present invention has arisen to mitigate and/or obviate the afore-described disadvantages of the conventional handles for scissors.

SUMMARY OF THE INVENTION

The primary objective of the present invention is to provide a cutting instrument having an adjustable handle for fitting the users' fingers of various sizes.

In accordance with one aspect of the invention, there is provided a cutting instrument comprising a pair of blades pivotally coupled together at a pivot shaft and each including a first end having a cutting edge formed thereon and each including a second end, a first handle attached to the second end of a first of the blades, a second handle attached to the second end of a second of the blades, and means for adjusting the second handle relative to the second blade.

The second handle adjusting means includes means for forcing the second handle to engage with the second end of the second blade. The second handle includes a slot formed therein for receiving the second end of the second blade, the second handle adjusting means includes a latch pivotally coupled to the second handle at a pivot axle, the latch includes a cam means for forcing the second handle to engage with the second end of the second blade.

The second handle includes a stop extended inward of the slot thereof, the second end of the second blade includes at least one recess formed therein for receiving the stop of the second handle and for securing the second handle to the second end of the second blade.

The first handle includes a base having a free end, a cap and means for securing the cap to the base for forming a loop for receiving a finger of a user. The first handle includes at least one aperture formed therein and includes a hole formed in the free end of the base, and the cap includes a first end engaged in the hole of the base and includes a second end engaged with the aperture of the first handle for securing the cap to the base. The first handle may include two or more apertures for receiving the second end of the cap and for adjusting the cap relative to the base and for fitting the users' fingers of various sizes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
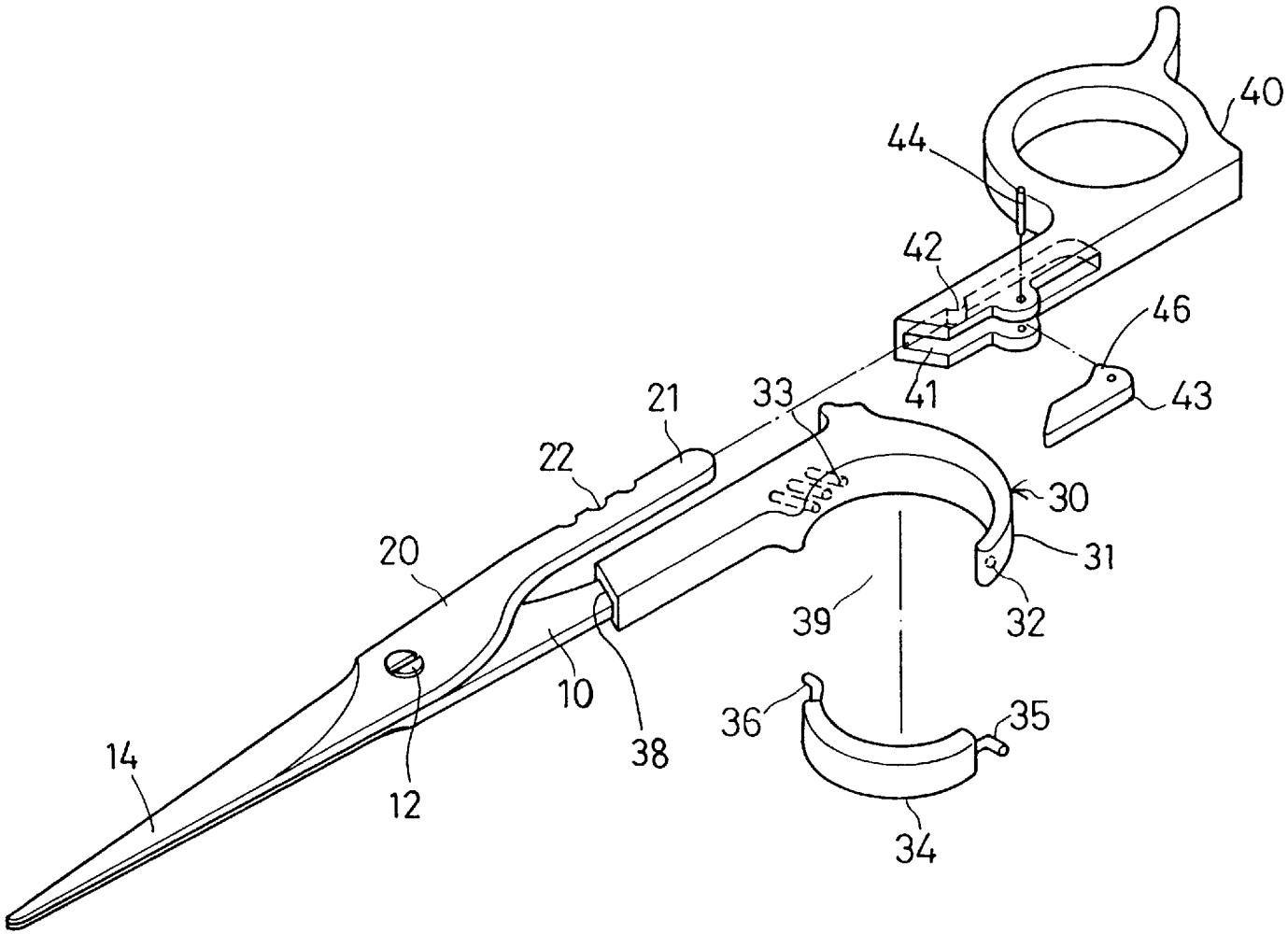
FIG. 1 is an exploded view of a cutting instrument in accordance with the present invention.
Figure 2:
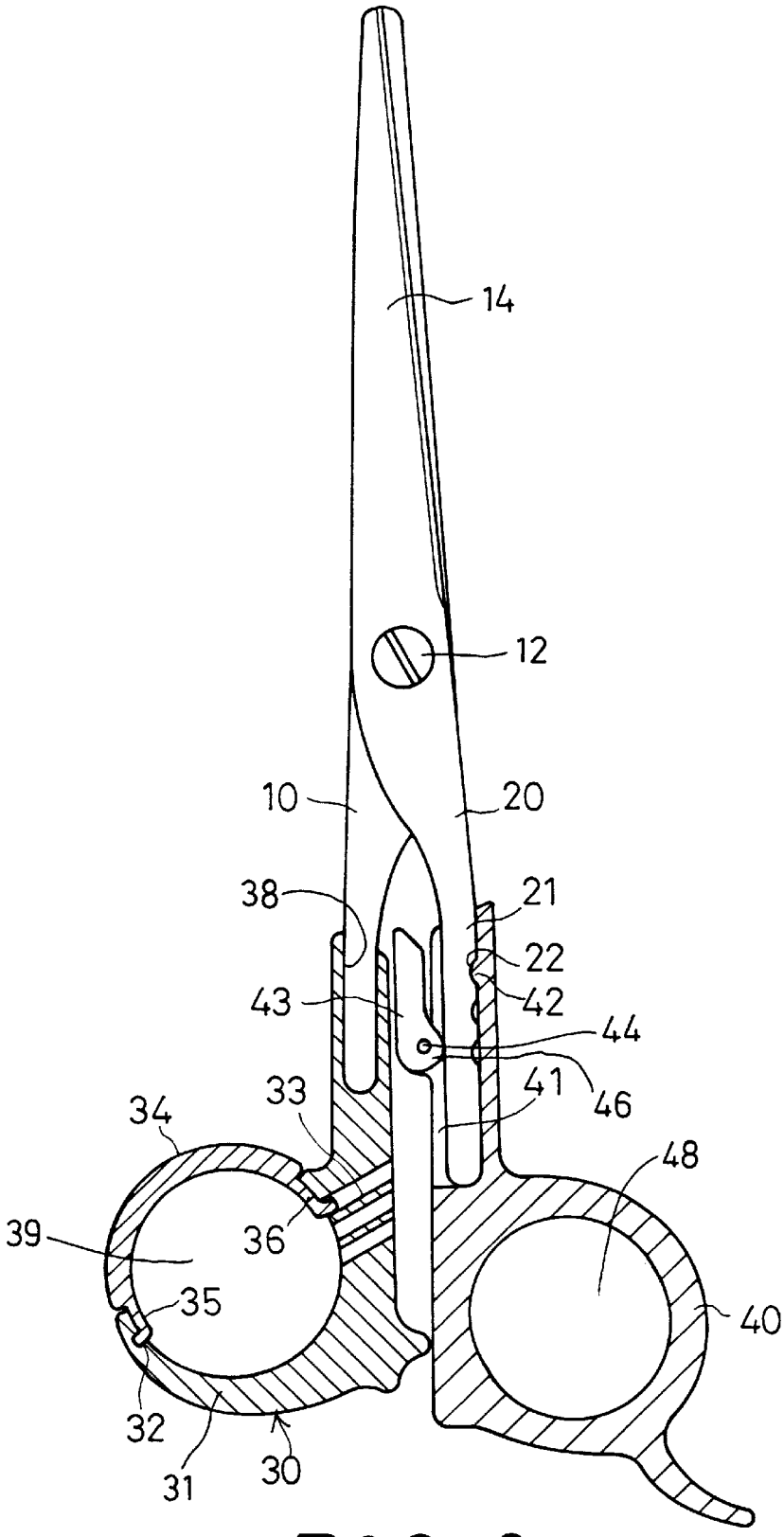
FIG. 2 is a partial cross sectional view of the cutting instrument.

Referring to the drawings, and initially to FIGS. 1 and 2, a cutting instrument in accordance with the present invention is particularly a pair of scissors and comprises a pair of blades 10, 20 pivotally coupled together at a pivot shaft 12 and each having a cutter edge 14 formed on one end and an extension 21 extended from the other end thereof. The extension 21 of the blade 20 includes one or more recesses 22 formed therein.

Figure 5:
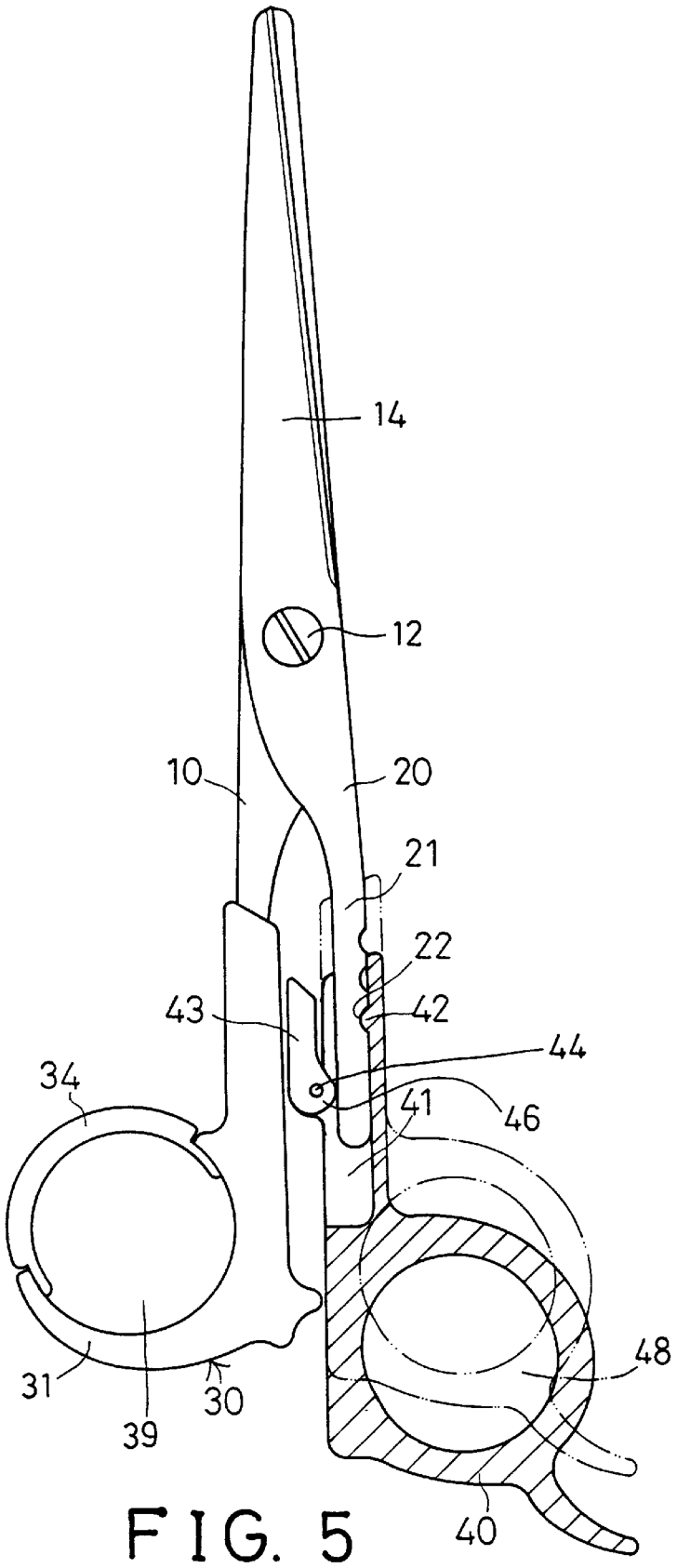
FIG. 5 is a partial cross sectional view similar to FIGS. 2 and 3, illustrating the operation of the cutting instrument.

A handle 40 includes a loop 48 for receiving the middle finger or the ring finger of the user and includes a slot 41 formed therein for slidably receiving the extension 21 of the blade 20 and includes a stop 42 extended inward of the slot 41 for engaging with either of the recesses 22 of the extension 21 of the blade 20. A latch 43 is pivotally coupled to the handle 40 at a pivot axle 44 and includes a cam 46 for engaging with the extension 21 and for forcing the stop 42 to engage with either of the recesses 22 of the extension 21 of the blade 20 and to lock the handle 40 to the extension 21 of the blade 20 (FIG. 2). The latch 43 form a quick-release securing mechanism for the handle 40. The handle 40 may be easily disengaged from and adjusted relative to the extension 21 (FIG. 5) by rotating the latch 43 about the pivot axle 44 and by disengaging the cam 46 from the extension 21. The stop 42 may be adjusted to engage with different recesses 22 for adjusting the distance between the loop 48 relative to the blade 20, according to the users' need.

Figure 3:
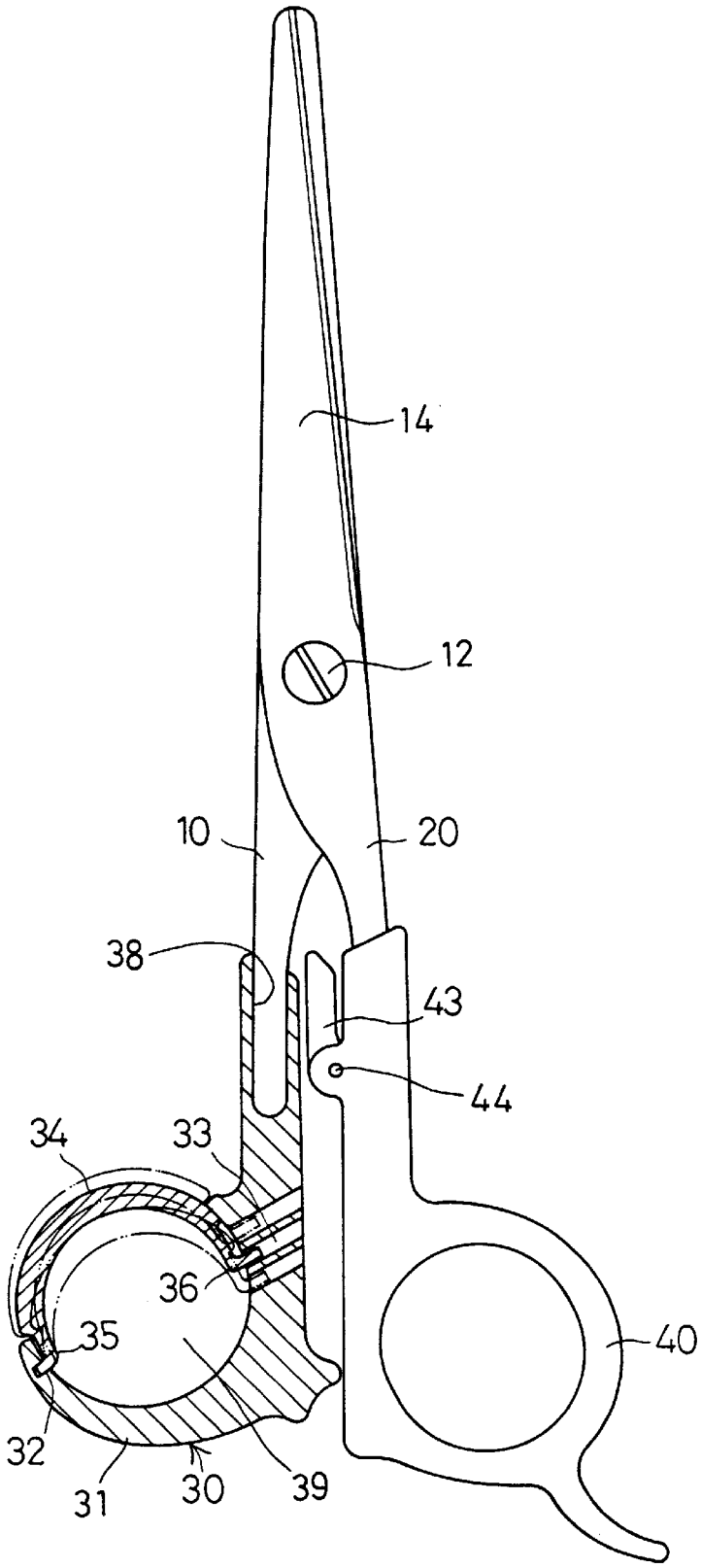
FIG. 3 is a partial cross sectional view similar to FIG. 2, illustrating the operation of the cutting instrument.
Figure 4:
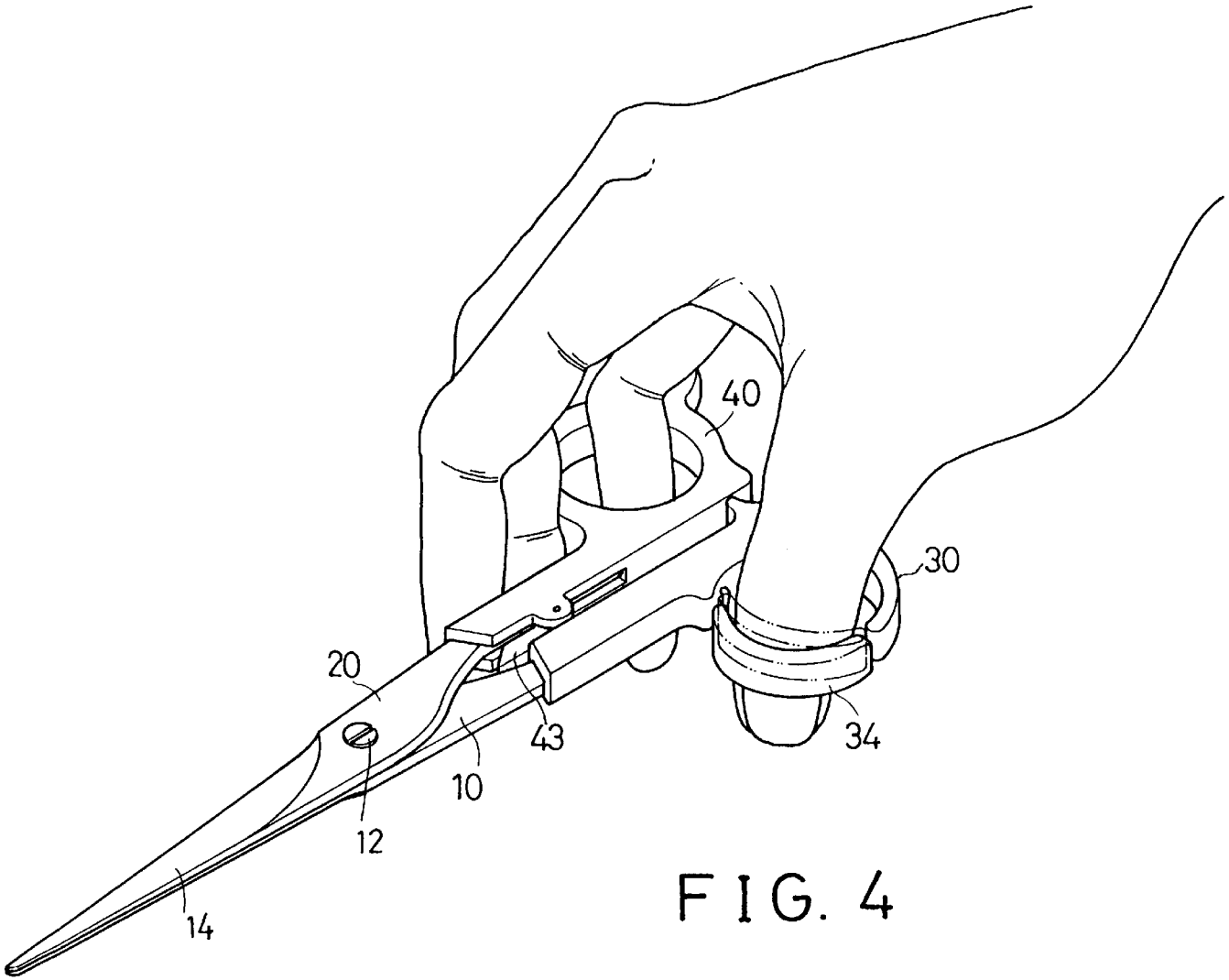
FIG. 4 is a perspective view illustrating the operation of the cutting instrument.

Another handle 30 includes a cavity 38 for receiving the extension of the other blade 10 and includes a curved base 31 formed in the bottom and includes a hole 32 formed in the free end of the curved base 31 and includes one or more apertures 33 formed in the middle portion of the handle 30. The handle 30 may be secured to the blade 10 by a force-fitted engagement or by an adhesive material or by a welding process. A curved cap 34 includes two ends each having a pin 35, 36 extended therefrom for engaging with the hole 32 and either of the apertures 33 (FIGS. 2–4) and for defining another loop 39 for receiving the thumb of the user. The pin may be adjusted to engage with different apertures 33 for fitting the different sizes of the thumbs of the users. The pins 35, 36 are preferably aligned in a pivot line for allowing the cap 34 to be rotated about the pins 35, 36 (FIG. 4) according to the movement of the thumb relative to the handle 30.

Figure 6:
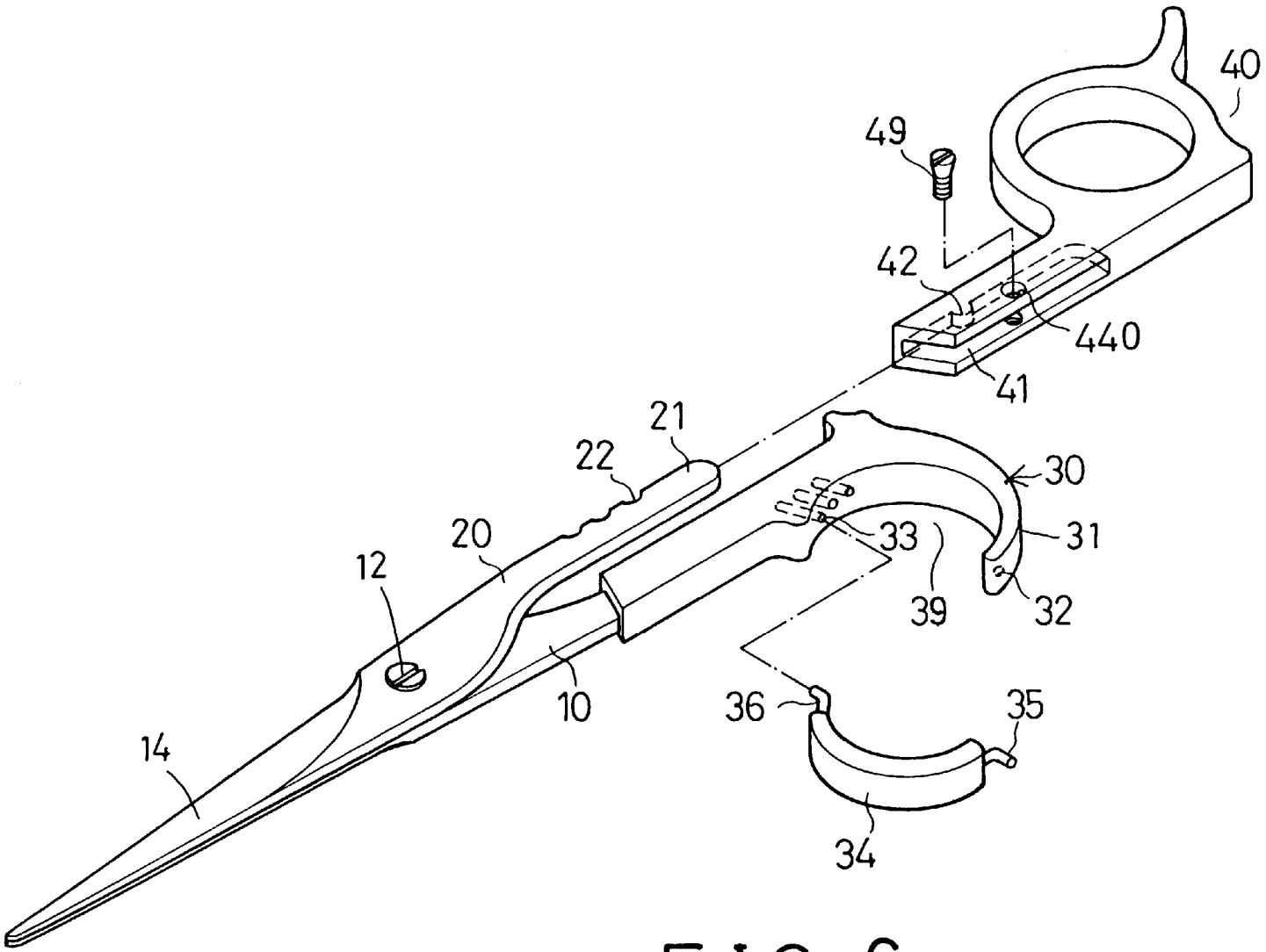
FIG. 6 is an exploded view illustrating the other application of the cutting instrument.
Figure 7:
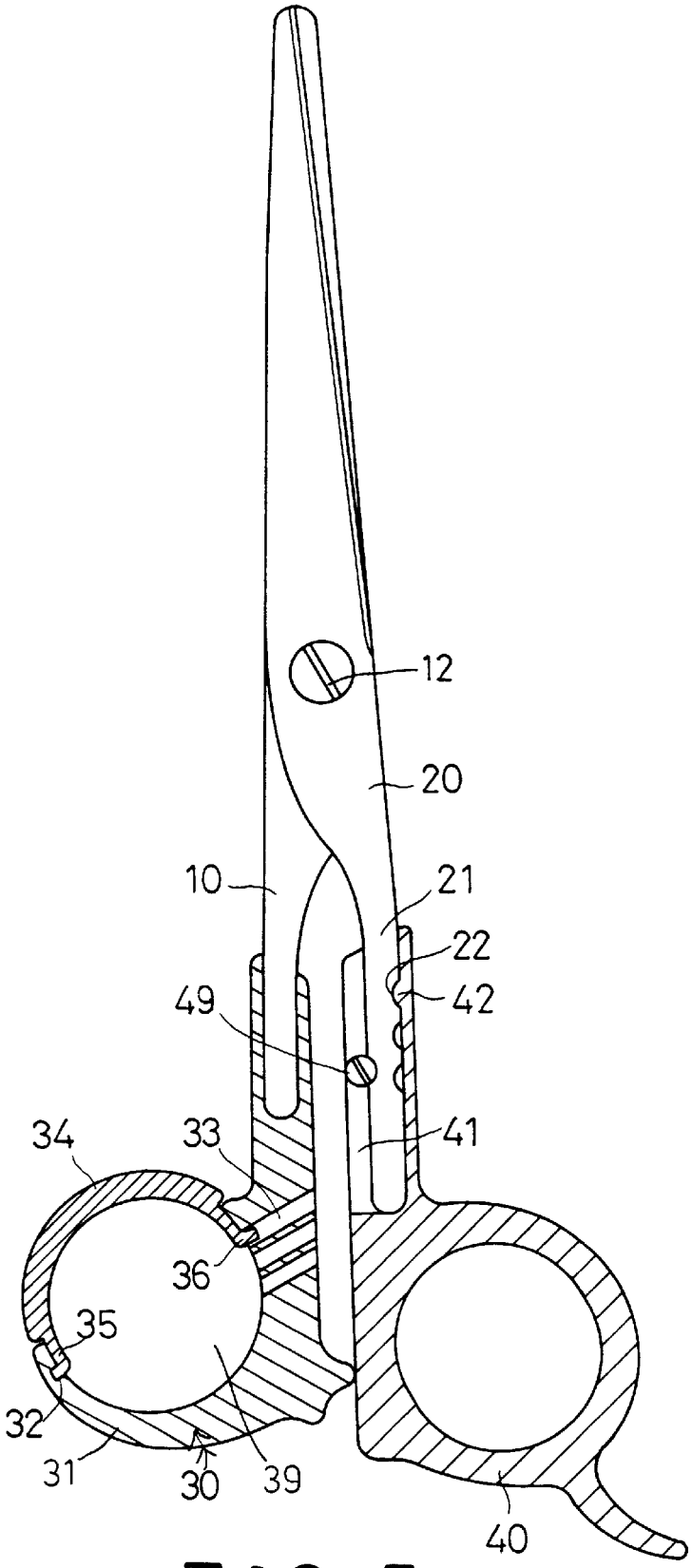
FIG. 7 is a cross sectional view of the cutting instrument as shown in FIG. 6.

Referring next to FIGS. 6 and 7, instead of the latch 43 as that shown in FIGS. 1–5, a fastener 49 may be engaged through a screw hole 440 of the handle 40 and engaged with the extension 21 (FIG. 7) for securing the handle 40 to the extension 21. The handle 40 may also be easily adjusted relative to the blade 20 by unthreading the threading the fastener 49 to the handle 40 and to engage with the extension 21.

Accordingly, the cutting instrument in accordance with the present invention includes an adjustable handle for fitting the users' fingers of various sizes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cutting instrument comprising:

a pair of blades pivotally coupled together at a pivot shaft and each including a first end having a cutting edge formed thereon and each including a second end;

a second handle attached to said second end of a second of said blades; and means for adjusting said second handle relative to said second blade.

wherein said second handle includes a slot formed therein for receiving said second end of said second blade, said second handle adjusting means includes a latch pivotally coupled to said second handle at a pivot axle, said latch includes a cam means for forcing said second handle to engage with said second end of said second blade.

2. The cutting instrument according to claim 1, wherein said second handle includes a stop extended inward of said slot thereof, said second end of said second blade includes at least one recess formed therein for receiving said stop of said second handle and for securing said second handle to said second end of said second blade.

3. The cutting instrument according to claim 1, wherein said first handle includes a base, a cap and means for securing said cap to said base for forming a loop for receiving a finger of a user.

4. The cutting instrument according to claim 1, wherein said first handle includes at least one aperture formed therein and includes a base having a free end, and includes a hole formed in said free end of said base, and a cap includes a first end engaged in said hole of said base and includes a second end engaged with said at least one aperture of said first handle for securing said cap to said base.

5. The cutting instrument according to claim 1, wherein said first handle includes at least two apertures formed therein and includes a base having a free end, and includes a hole formed in said free end of said base, and a cap includes a first end engaged in said hole of said base and includes a second end engaged with either of said at least two apertures of said first handle for securing said cap to said base and for adjusting said cap relative to said base.

6. A cutting instrument comprising:

a pair of blades pivotally coupled together at a pivot shaft and each including a first end having a cutting edge formed thereon and each including a second end, a first handle attached to said second end of a first of said blades, said first handle including a base, a cap, and means for securing said cap to said base for forming a loop for receiving a finger of a user, and a second handle attached to said second end of a second of said blades.

7. The cutting instrument according to claim 6, wherein said base of said first handle includes a free end, said first handle includes at least one aperture formed therein and includes a hole formed in said free end of said base, and said cap includes a first end engaged in said hole of said base and includes a second end engaged with said at least one aperture of said first handle for securing said cap to said base.

8. The cutting instrument according to claim 6, wherein said first handle includes at least two apertures and a hole formed therein, and said cap includes a first end engaged in said hole of said base and includes a second end engaged with either of said at least two apertures of said first handle.

9. The cutting instrument according to claim 6, further comprising means for adjusting said second handle relative to said second blade.

* * * * *